United States Patent [19]

Bryce

[11] Patent Number: 4,662,050

[45] Date of Patent: May 5, 1987

[54] REAR SEAL INSTALLATION GUIDE DEVICE

[76] Inventor: James L. Bryce, R.R. #2, Wingham, Ontario, Canada, N0G 2W0

[21] Appl. No.: 799,336

[22] Filed: Nov. 18, 1985

[30] Foreign Application Priority Data

Oct. 25, 1985 [CA] Canada ..... 494173

[51] Int. Cl.[4] ..... B25B 27/14

[52] U.S. Cl. ..... 29/281.5

[58] Field of Search ..... 29/271, 275, 281.5, 29/254, 402.02, 235, 241, 433, 451; 254/134.3 R, 134.3 FT; 277/1

[56] References Cited

U.S. PATENT DOCUMENTS

| | | | |
|---|---|---|---|
| 2,621,398 | 12/1952 | Simmons . | |
| 2,800,708 | 7/1957 | Coleman | 29/275 |
| 3,020,332 | 2/1962 | Appleton | 254/134.3 R |
| 3,084,423 | 4/1963 | Fullerton . | |
| 3,201,090 | 8/1965 | Jones | 254/134.3 FT |
| 4,151,903 | 5/1979 | Martino | 254/134.3 R |
| 4,456,225 | 6/1984 | Lucas | 254/134.3 R |

*Primary Examiner*—Robert C. Watson

*Attorney, Agent, or Firm*—Riches, McKenzie & Herbert

[57] ABSTRACT

This application relates to a guide device or tool to facilitate the replacement of the upper rear seal in an internal combustion engine. The seal is mounted on a semicircular rigid seal retainer with an outer flange, and the guide device provides for their reinstallation with the flange being received in a curved groove in the block without requiring the removal of the crankshaft from the engine block. The guide device is bolted to the block using one of the empty bolt holes normally used to hold the lower rear main bearing in place. The device has a steel body with an arc shaped edge which extends around a portion of the crankshaft and a number of spaced pins which project from one side of the body adjacent the arc shaped edge. The spaced pins are located so their inner sides form a segment of a circle which is equal in diameter to the outer flange of the seal retainer and in alignment with the groove in the block. In order to install the upper seal and retainer, one end is manually slid as far as possible into the groove, with the outer flange bearing against the spaced pins. The other end of the seal retainer is then tapped with a hammer and the spaced pins act to translate the force around the semicircular retainer to overcome the frictional forces from the crankshaft and groove to allow the seal and retainer to be driven into place.

6 Claims, 5 Drawing Figures

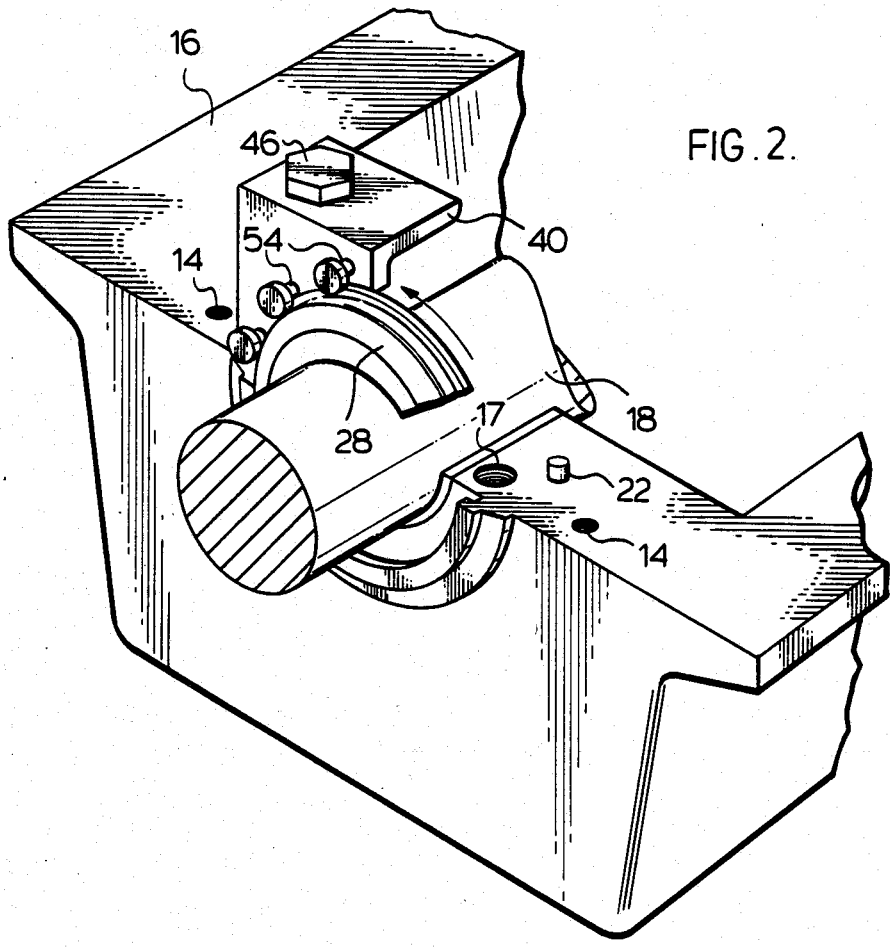
FIG. 2.
FIG. 3.
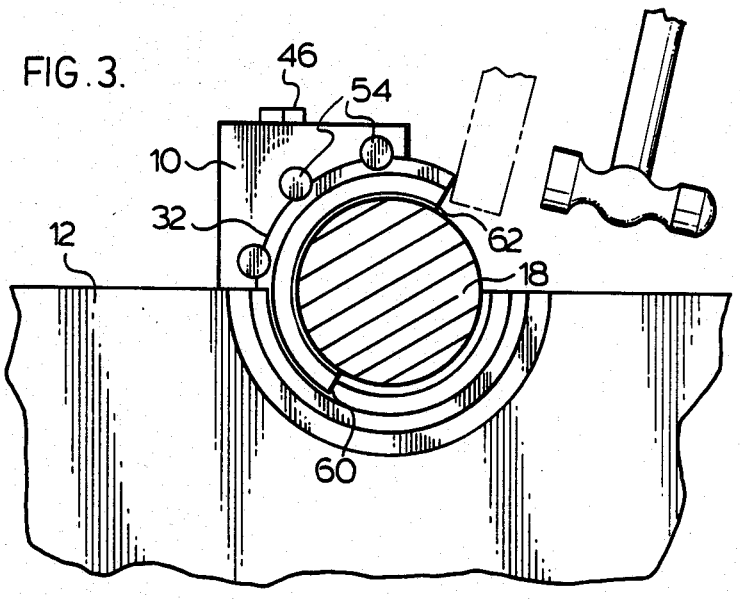

REAR SEAL INSTALLATION GUIDE DEVICE

BACKGROUND OF THE INVENTION

This invention relates to a device which facilitates the replacement of the upper rear oil seal in an internal combustion engine.

As is well known, an engine has a lower seal and a matching upper seal which extend around the crankshaft to prevent the leakage of oil. The seals are strips of jute type material having a tar base and the lower seal is mounted in a semicircular lower seal retainer which is bolted to the engine block. The upper seal is similarly securely mounted in a curved inner groove in a semicircular metal upper seal retainer. The upper seal retainer has an outer flange which is received in a groove in the engine block to frictionally secure the seal and retainer unit in a tight sealing position between the block and the crankshaft.

When the seals wear and start to leak, they must be replaced. This is done by removing the seal and seal retainer, replacing the worn seal by a new seal, and reinstalling the seal and retainer unit. This is a relatively simple procedure for the lower seal, as the lower seal retainer can be removed by simply unbolting it from the engine block. However, the normal procedure for replacing the upper seal is much more difficult and very time consuming. While the seal and seal retainer can usually be slid lengthwise out of the curved groove in the block by tapping on one end with a hammer and punch, the problem arises in trying to reverse the procedure after the new seal has been installed. While one end of the seal retainer can be started in the groove, it has been found that tapping on the other end of the seal retainer merely jams it due to its semicircular shape and the frictional forces against the block and crankshaft. Thus, the standard procedure for replacing upper rear seals of this type is to remove the crankshaft, remove the seal retainer and replace the seal, and then reinstall the crankshaft. As will be appreciated, this is a time consuming and expensive procedure to simply replace a leaking seal.

Earlier attempts to simplify the procedure for replacing real seals are shown in U.S. Pat. Nos. 2,621,398 to Simmons which issued Dec. 16, 1952 and 3,084,423 to Fullerton which issued Apr. 9, 1963. Both of these prior patents relate to the concept of gradually "funneling" the seal as it is drawn into a groove in the engine block. However, this does not relate to the present case where the seal is mounted on a rigid seal retainer which is then driven into the groove in the block.

SUMMARY OF THE INVENTION

Accordingly, it is an object of the invention to at least partially overcome the disadvantages of the prior art by providing a guide device which facilitates replacement of an upper real seal of an internal combustion engine by providing for the installation of the seal mounted on a rigid seal retainer without removing the crankshaft.

To this end, in one of its aspects, the invention provides a removable guide device to faciliate installation of an upper rear seal mounted on a semicircular rigid seal retainer in frictional engagement between the crankshaft and block of an internal combustion engine, the block having curved groove means to receive an outer flange of the seal retainer, the device comprising a body adapted to be mounted on the engine block to extend around a radial segment of the crankshaft; attachment means to removably mount the body of the device on the engine block adjacent to the groove means; and guide means on the body to receive the outer flange of the seal retainer in alignment with the groove means, whereby, when the semicircular seal retainer and seal are positioned with one end started in the groove means and the outer flange bearing against the guide means and a linear force is applied to the other end of the seal retainer to drive the seal retainer and seal into position between the crankshaft and the block, the guide means act to direct the linear force around the curved seal retainer to overcome friction from the crankshaft and groove means.

Further objects and advantages of the invention will appear from the following description taken together with the accompanying drawings.

BRIEF DESCRIPTION OF THE DRAWINGS

FIG. 2 is a similar view showing the guide device attached to the block and the seal and seal retainer started into the groove;

FIGS. 3 and 4 are elevation views showing the seal and seal retainer being driven into position.

DESCRIPTION OF THE PREFERRED EMBODIMENTS

Figure 1:
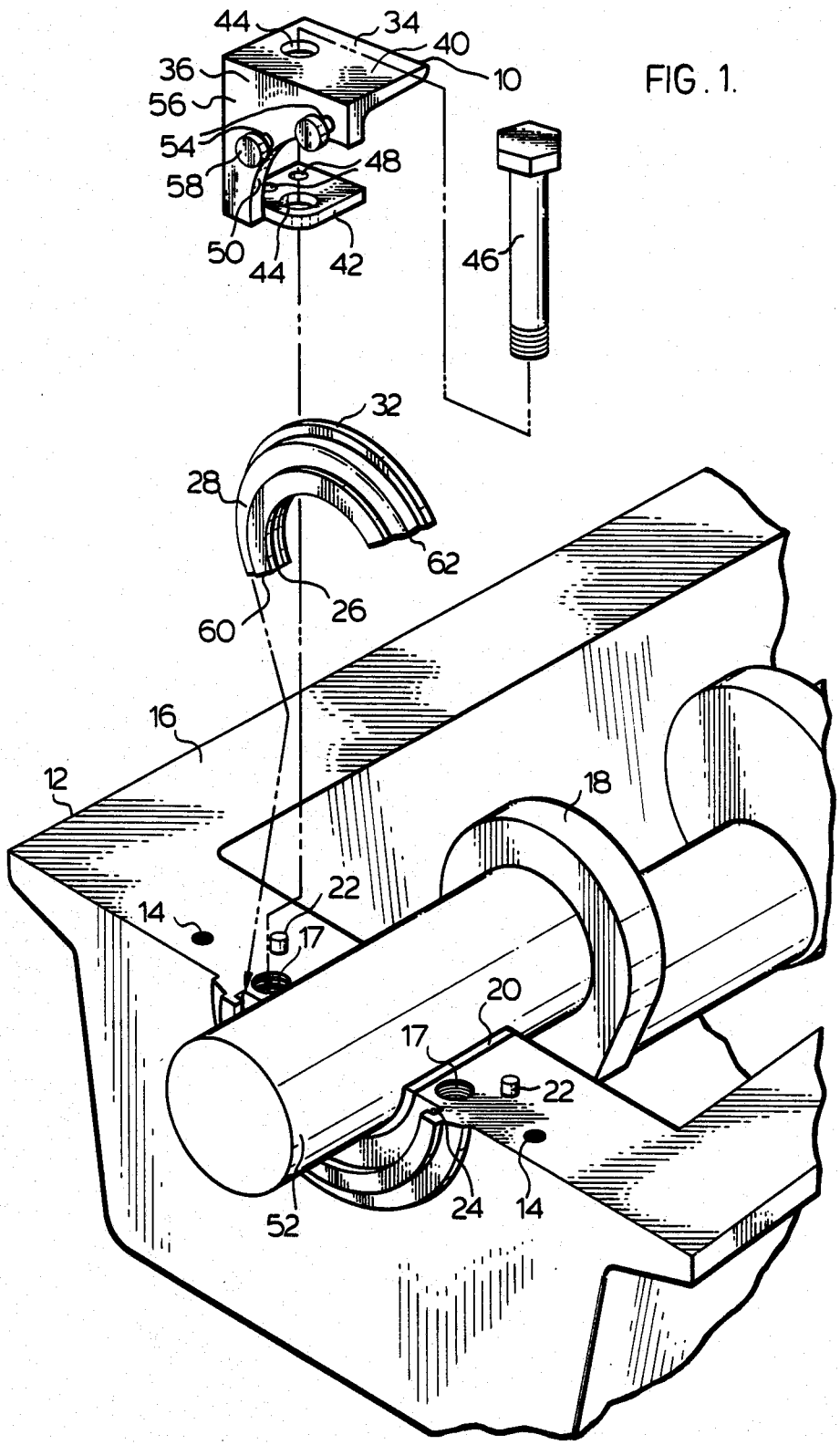
FIG. 1 is an exploded isometric view showing a portion of an inverted engine block from the rear with a guide device according to a preferred embodiment of the invention to be attached in position on the block.
Figure 5:
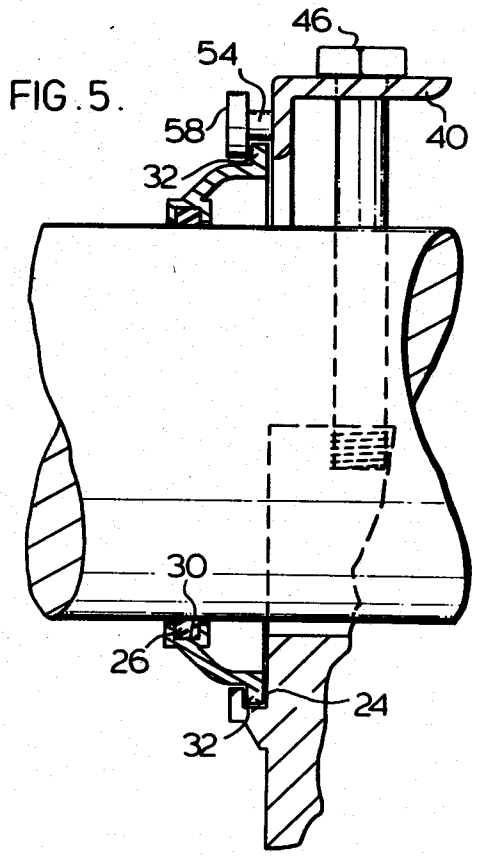
FIG. 5 is a sectional view taking along line 5—5 in FIG. 4.
Figure 4:
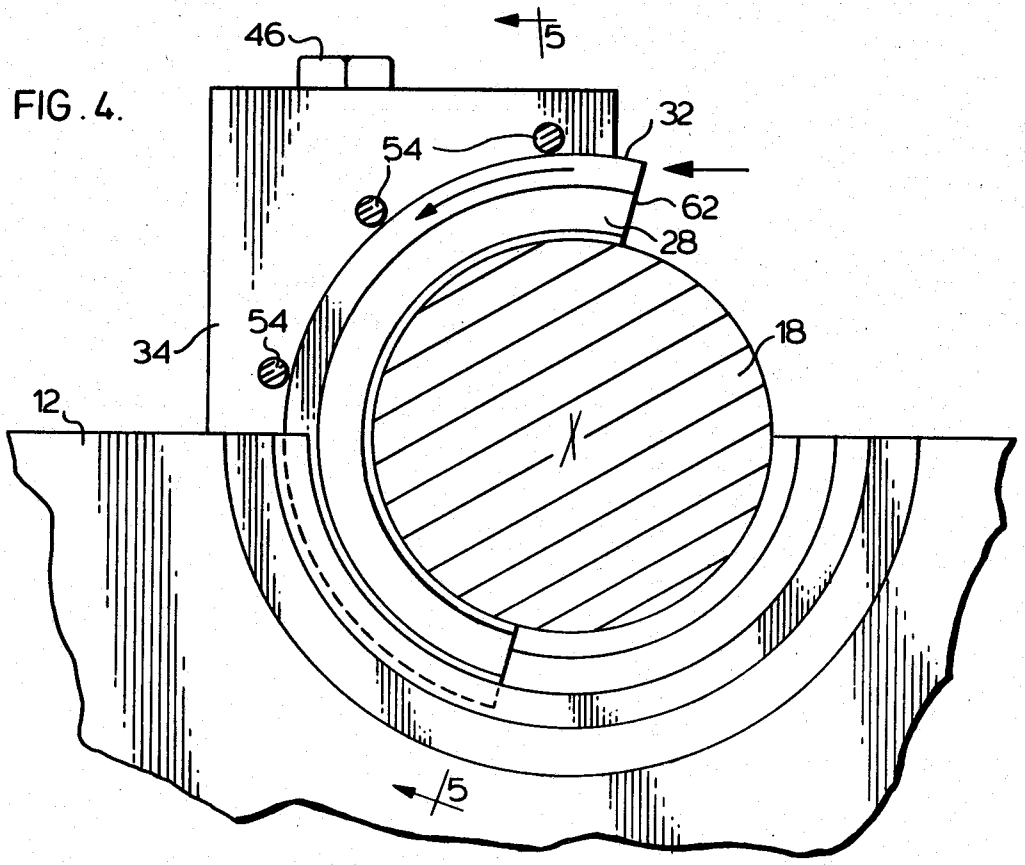

Reference is first made to FIG. 1 which shows a guide device 10 according to a preferred embodiment of the invention in position to be installed on the block 12 of the engine. In this case, the engine illustrated is a CONTINENTAL (trade mark of the Teledyne Total Power Corporation of Memphis, Tennessee) 6 cylinder model F227-F245 or 4 cylinder model F163. As illustrated, the oil pan has been removed and the engine inverted for easier accessability. The lower seal and seal retainer (not shown) have been removed by unscrewing retaining bolts from holes 14 in the lower surface 16 of the block 12. The lower rear main bearing has similarly been removed by unscrewing bolts from holes 17. This exposes the crankshaft 18 which extends through a rear bearing 20 seated in the engine block 12. In addition to the threaded bolt holes 14 and 17, the lower surface 16 of the block 12 also has adjacent alignment pins 22 which assist in installing the rear bearing 20 and are normally received in holes on the lower seal retainer (not shown). The block 12 is also formed with a semicircular groove 24 which extends around the crankshaft 18 rearwardly of the bearing 20.

The rear oil seal for the engine is provided by a semicircular lower seal and seal retainer and a matching semicircular upper seal 26 and seal retainer 28 which fit tightly around the crankshaft 18. The seal 26 is normally made of a strip of jute type material with a tar base and is securely mounted in an inner groove 30 in the upper seal retainer 28. The semicircular upper seal retainer 28 has an outer flange 32 which fits into the groove 24 in the block to frictionally secure the upper seal 26 and seal retainer 28 between the block and the crankshaft. It will be apparent that this must be a tight fit to provide the necessary seal against the leakage of oil from the engine.

After considerable wear and aging, the seal 26 will occasionally start to leak and need to be replaced by a new seal. The seal 26 and seal retainer 28 can be slid lengthwise out of engagement in the groove by tapping on one end with a hammer and punch. However, after the worn seal 26 has been replaced in the inner groove 30, it has been found to be very difficult to reverse the procedure and slid the seal and retainer back into place between the crankshaft 18 and the block 12. Thus, as mentioned above, the standard procedure as recommended by the manufacturer of the engine is to remove the crankshaft 18. However, this is a time consuming step and it has been found that approximately fifteen hours of labour can be saved if this step is eliminated.

The guide device 10 illustrated according to a preferred embodiment of the invention has a steel body 34 with a flat vertical plate 36 extending between a lower horizontal flange portion 40 and a shorter upper horizontal flange portion 42. The spaced upper and lower flange portions have aligned bolt openings 44 extending therethrough to receive a bolt 46 which is screwed into one of the bolt holes 17 in the lower surface 16 of the block 12. The upper flange portion 42 also has pin openings 48 to receive the alignment pin 22 protruding from the flat lower surface 16 of the block. In the embodiment shown, two openings 48 are provided for two different engine models having the pin 22 in slightly different locations. The plate 36 has an arced edge 50 which extends radially around a portion of the outer surface 52 of the crankshaft. The plate 36 also has a number of spaced pins 54 projecting from one side 56 adjacent its arced edge 50. The pins 54 each have enlarged heads 58 and are located so their inner sides extend along a segment of a circle equal in diameter to the outer flange 32 of the lower seal retainer 28.

In use, after the worn seal 26 and retainer 28 have been removed and the seal replaced, the guide device 10 is bolted into place on the engine block 12. When the upper flange portion 42 is tightened against the lower surface 16 of the block, the location pin 22 is received in the pin opening 48 in the upper angle iron, which ensures the guide device 10 does not rotate during use. In this position, the inner sides of the spaced pins 54 are in alignment with the semicircular groove 24 in the block. As shown in FIG. 2, the seal 26 and retainer 28 are then manually started with one end 60 in the groove 24 and the outer flange 32 bearing against the spaced pins 54. The seal and retainer are manually slid as far as possible around the crankshaft until they jam, and then the other end 62 of the seal retainer is tapped with a hammer to drive them into place between the engine block and the crankshaft. It has been found that the contact between the outer flange 32 and the spaced pins 54 acts to translate or direct sufficient of the linear force from the hammer around the curved retainer to overcome the considerable frictional forces from the crankshaft and the groove to allow the seal 26 and seal retainer 28 to be driven into place. The seal retainer is formed of a suitable rigid and durable material such as a steel or white metal alloy. The guide device 10 is then removed, the lower seal and seal retainer bolted into place, and the oil pan is replaced. It will be appreciated that eliminating and removing the crankshaft saves a considerable labour cost and also reduces other difficulties that occasionally arise during this procedure.

Although the description of this invention has been given with respect to a particular embodiment of the invention, it is not to be construed in a limiting sense. Variations and modifications will occur to those skilled in the art. For instance, while the enlarged heads 58 of the spaced pins 54 are advantageous to guide the outer flange 32 of the lower seal retainer 28 in alignment with the groove 24 in the block, they are not required in all instances. In fact, the spaced pins 54 themselves can be replaced by a curved flange or groove arrangement in alignment with the semicircular groove 24 in the block. Similarly, the structure of the body 34 of the device can be considerably different and remain within the scope of the invention. Reference is made to the appended claims for a definition of the invention.

What I claim is:

1. A removable guide device to facilitate installation of an upper rear seal mounted on a semicircular rigid seal retainer in frictional engagement between the crankshaft and block of an internal combustion engine, the block having curved groove means to receive an outer flange of the seal retainer, the device comprising:

(a) a body having a radially extending portion;

(b) attachment means to removably mount the body of the device on the engine block adjacent to the groove means wherein the radially extending portion extends around a radial segment of the crankshaft; and (c) flange guide means located along the radially extending portion of the body to receive the outer flange of the seal retainer in alignment with the groove means, whereby, when the semicircular seal retainer and seal are positioned with one end started in the groove means and the outer flange bearing against the guide means and a linear force is applied to the other end of the seal retainer to drive the seal retainer and seal into position between the crankshaft and the block, the guide means act to direct the linear force around the curved seal retainer to overcome friction from the crankshaft and groove means.

2. A guide device as claimed in claim 1 wherein the guide means comprise a plurality of spaced pins projecting from one side of the body along a segment of a circle substantially equal in diameter to the outer flange of the seal retainer.

3. A guide device as claimed in claim 2 wherein the pins have enlarged heads which are spaced from the body a distance slightly greater than the width of the outer flange of the seal retainer.

4. A guide device as claimed in claim 2 wherein the attachment means includes a bolt which extends through a first opening in the body and is received in a first existing hole in the block.

5. A guide device as claimed in claim 4 wherein the attachment means further includes a pin hole to receive an alignment pin projecting from the block.

6. A guide device as claimed in claim 5 wherein the body comprises a flat plate extending between upper and lower flange portions with the upper and lower flange portions having aligned first openings extending therethrough to receive the bolt therethrough to secure the device in position with the shorter upper flange portion abutting against a lower surface of the block, the upper flange portion also having a second opening therethrough to receive the alignment pin which projects from the lower surface of the block, the plate having an arced edge which extends around a radial segment of the crankshaft, the spaced pins projecting from one side of the plate adjacent the arced edge.

* * * * *